United States Patent [19]

Yamaji et al.

[11] 4,438,580

[45] Mar. 27, 1984

[54] STACKING TYPE MOVABLE LARGE DISPLAY DEVICE

[75] Inventors: Masamura Yamaji; Shozo Fujita; Shunichi Futatsuishi; Takashi Takushima, all of Nagasaki, Japan

[73] Assignee: Mitsubishi Denki Kabushiki Kaisha, Tokyo, Japan

[21] Appl. No.: 399,587

[22] Filed: Jul. 19, 1982

[30] Foreign Application Priority Data

Jul. 20, 1981 [JP] Japan ..... 56-114143

[51] Int. Cl.[3] ..... G09F 21/04

[52] U.S. Cl. ..... 40/590; 296/1 R; 340/700

[58] Field of Search ..... 40/590, 591, 588, 589; 46/17; 273/157 R; 296/1 R; 340/670, 365 R, 807; 353/13

[56] References Cited

U.S. PATENT DOCUMENTS

| | | | |
|---|---|---|---|
| 3,475,045 | 10/1969 | Cordes | 296/1 R |
| 4,035,940 | 7/1977 | Mickey et al. | 40/590 |
| 4,043,056 | 8/1977 | Savage | 273/157 R |
| 4,110,792 | 8/1978 | Long et al. | 340/700 |
| 4,136,480 | 1/1979 | Fabricant et al. | 46/17 |

FOREIGN PATENT DOCUMENTS

| | | | |
|---|---|---|---|
| 2447741 | 8/1980 | France | 296/1 R |

*Primary Examiner*—Gene Mancene
*Assistant Examiner*—James Hakomaki
*Attorney, Agent, or Firm*—Sughrue, Mion, Zinn, Macpeak & Seas

[57] ABSTRACT

A large scale display device is made up of a plurality of stackable display blocks which are assembled on location. The lowermost block is secured to a trailer having supporting outriggers.

5 Claims, 2 Drawing Figures

STACKING TYPE MOVABLE LARGE DISPLAY DEVICE

BACKGROUND OF THE INVENTION

This invention relates to the construction of a large visual display device.

A large display device is intended to be viewed by a number of persons simultaneously. Therefore, in general, the display section is at least 5 m in height and at least 8 m in width, and sometimes the size of the display section plus its auxiliary structure is at least 6 m in height and at least 10 m in width. Accordingly, it is impossible to transmit the large display device per se, for instance, because of traffic regulations. In addition, the efficiency of use of the display device depends on how quickly and readily the display device can be installed at a desired place. Typical of known portable large sized display devices is that of U.S. Pat. No. 4,110,792 to Long. This patent discloses a vehicle mounted display apparatus having a trio of hinged panels which are folded one over the other for transport, and which may be pivotted into a flat shape for use. The panels are supported by a partially collapsible frame structure, so that the panels are rotated through 90° from the transport to the display position. Such a system is disadvantageous in that there is insufficient structural stability of the system.

SUMMARY OF THE INVENTION

Accordingly, an object of this invention is to provide a large display unit made up of two or three display blocks which can readily be transported to a desired place, and can be stacked one on another with a truck crane or the like at the place, and which, under this condition, can operate by merely electrically connecting the display blocks to one another.

DETAILED DESCRIPTION OF THE PREFERRED EMBODIMENTS

One embodiment of this invention, in which a large display device comprises two display blocks, will be described with reference to the accompanying drawings.

Figure 1:
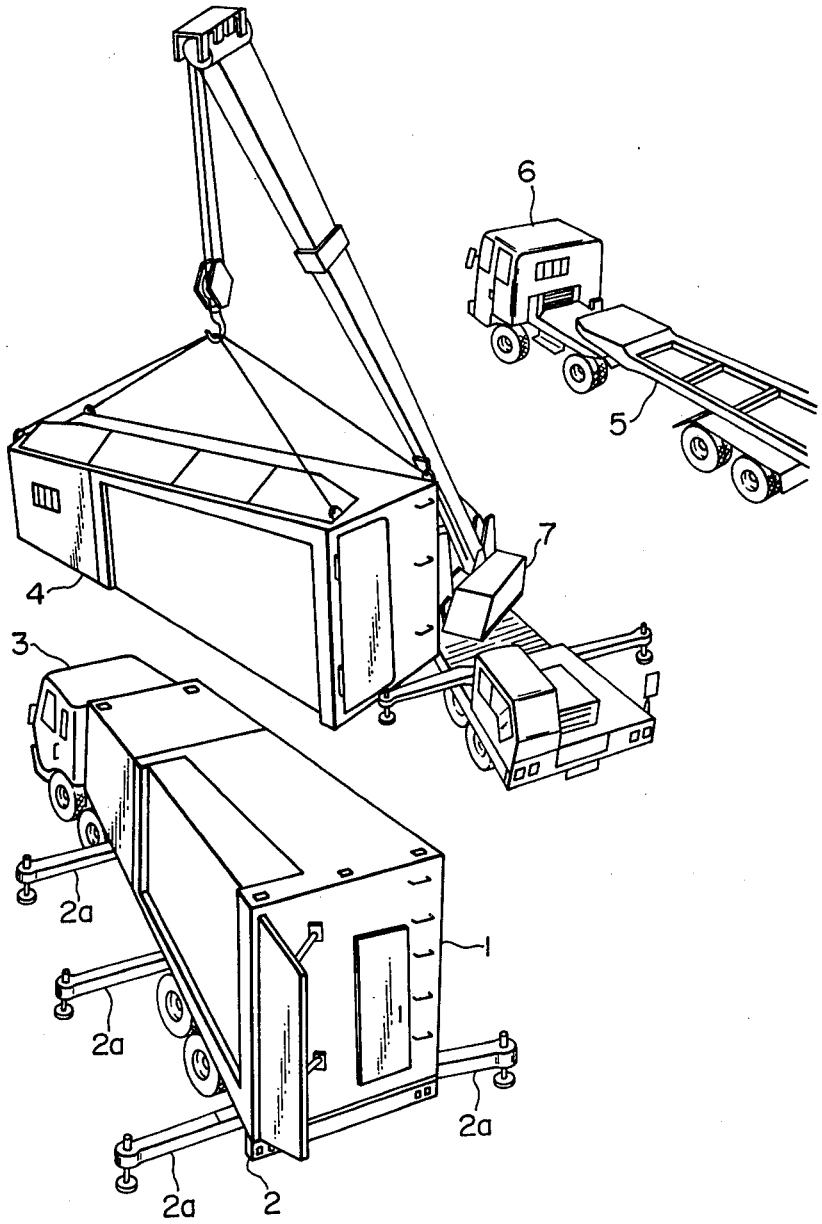
FIG. 1 is an explanatory diagram showing the assembly of a plurality of display blocks into a stacked type large display device which is movable to a desired location.
Figure 2:
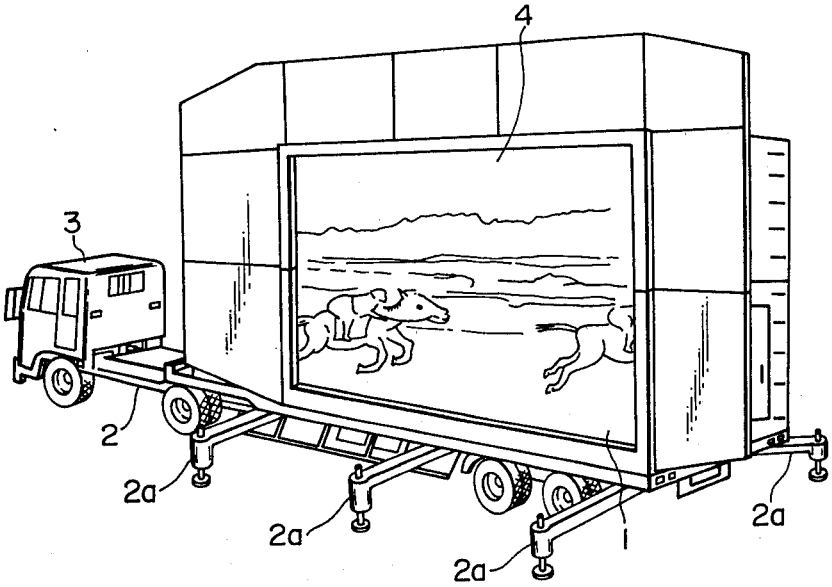
FIG. 2 is an explanatory diagram showing the operation of the large display device provided through the operation shown in FIG. 1.

FIG. 1 shows the operation of assembling two display blocks, and FIG. 2 shows the operation of the display device provided by assembling the two display blocks.

In FIG. 1, reference numeral 1 designates a lower display block; 2, a trailer on which the lower display block is loaded, the trailer 2 having several outriggers 2*a* for preventing tipping of the trailer; 3, a tractor; 4, an upper display block; 5, a trailer for loading the upper display block; 6, a tractor; and 7, a truck crane for stacking the upper display block 4 on the lower display block 1.

As shown in FIG. 1, after the trailers with the display blocks have been transported to a desired place by the tractors 3 and 6, the lower display block is fixedly positioned with the outriggers 2*a* of the trailer 2 on which the lower display block 1 has been loaded extended, and thereafter the upper display block 4 is lifted from the trailer 5 with the truck crane 7 and is stacked on the lower display block 1.

FIG. 2 shows the operation of the display device provided by stacking the upper display block on the lower display block according to the method described with reference to FIG. 1, and by electrically wiring the upper and lower display blocks 1 and 4.

Standard hooking means according to the international container standard are provided to fixedly secure the display blocks 1 and 4 to the trailers 2 and 5 and to fixedly secure the display blocks 1 and 4 to each other. That is, the display blocks and the trailers may be readily secured. Each of the display blocks 1 and 4 is of a water-proof and sealed construction, so that it can be transported as it is. That is, the display blocks 1 and 4 require no additional water-proof covers or the like.

The above-described embodiment employs two display blocks; however, it goes without saying that the display device may comprise more than two display blocks.

As is clear from the above description, the large display device comprises a plurality of display blocks which can be stacked one on another and which can be transported by trailers. The trailer can be fixedly positioned at any location with its outriggers extended and the display blocks can be stacked on one another, so long as the selected location is strong enough to support the large display device.

What is claimed is:

1. A display device, comprising: a plurality of movable display blocks each having a display area segment with said plurality of display blocks being stackable one onto another such that together, said display area segments of said plurality of display blocks form a predetermined display area surface, a lowermost one of said display blocks being secured to a trailer having supporting outriggers, remaining ones of said display blocks being detachably secured to respective trailers, means for detachably securing said display blocks to each other when said display blocks are assembled to form said predetermined display area surface.

2. A device as claimed in claim 1, said display blocks being waterproof.

3. A device as claimed in claim 1, further comprising means for electronically linking said display blocks together when said display blocks are assembled to form said predetermined display area surface.

4. A device as claimed in claim 1, wherein each of said display blocks has a rectilinear shape and has a length and width sized such that said remaining ones of said display blocks can be stacked on said lowermost one of said display blocks without the need of frames to support said remaining ones of said display blocks.

5. A device as claimed in claim 1, wherein said predetermined surface area is at least 5 m high and 8 m wide.

* * * * *